United States Patent [19]

Sidwell

[11] 4,340,665

[45] Jul. 20, 1982

[54] SILVER HALIDE FILM

[75] Inventor: Lloyd G. Sidwell, Hendersonville, N.C.

[73] Assignee: E. I. Du Pont de Nemours and Company, Wilmington, Del.

[21] Appl. No.: 240,416

[22] Filed: Mar. 4, 1981

[51] Int. Cl.[3] ..... G03C 1/34

[52] U.S. Cl. ..... 430/539; 430/607; 430/610; 430/564

[58] Field of Search ..... 430/610, 607, 564, 539, 430/631, 634, 491, 551

[56] References Cited

U.S. PATENT DOCUMENTS

| | | | |
|---|---|---|---|
| 2,172,216 | 9/1939 | Miller | 430/491 |
| 3,312,552 | 4/1967 | Müller-Bardorff | 430/607 |
| 3,382,071 | 5/1968 | Bodenstein | 430/607 |
| 3,443,951 | 5/1969 | Willems et al. | 430/610 |
| 3,690,892 | 9/1972 | Fairbanks et al. | 430/607 |

FOREIGN PATENT DOCUMENTS

| | | | |
|---|---|---|---|
| 952162 | 3/1964 | United Kingdom | 430/610 |

*Primary Examiner*—Won H. Louie, Jr.

[57] ABSTRACT

Spots due to iron contamination in developed silver halide films are reduced in number by incorporating therein a phosphate and trisodium hydroxyethylethylenediaminetriacetate.

7 Claims, No Drawings

SILVER HALIDE FILM

FIELD OF THE INVENTION

This invention pertains to silver halide photographic films which on development exhibit spots due to metal particle contamination. A synergistic phosphate-chelate combination provides a means of reducing such spots.

BACKGROUND OF THE INVENTION

During the manufacturing process for producing silver halide films, precautions are taken to avoid metal contamination. However, fine metal particles are produced by the machinery which is used in the manufacturing process itself. Iron is the main contaminant, which gives rise to two types of spot problems.

Iron metal in the form of very fine particles can be easily oxidized to Fe(II) and Fe(III). The presence of Fe(III) can desensitize the silver halide to produce a halo effect, and the lowering in silver density of the developed silver halide film creates a grey spot. The oxidation of Fe to Fe(II), and Fe(II) to Fe(III), is accompanied by an electron release which creates sensitized spots in a developed silver halide film. At these sensitized spots there is an increased silver density, and the resulting spots are black.

Thus both grey and black spots can be produced in a film contaminated by iron in variable oxidation states. Grey spots appear to be characterized by greater radii than black spots. A scanning electron microscope probe reveals iron at the center of some grey spot halos. In an X-ray film such spots can obviously interfere with medical diagnosis.

It is known in the art of use sequestering agents of the phosphoric acid type, e.g., alkali metal metaphosphates, to prevent spot formation of the type described above, but these introduce other problems, as pointed out in U.S. Pat. No. 3,443,951 "Photographic Light-Sensitive Materials Containing Phosphoric Acid Ester of Aliphatic Polyols", U.S. Pat. No. 3,312,552 "Spot Prevention in Light-Sensitive Silver Halide Emulsion Layers" and U.S. Pat. No. 3,382,071 "Silver Halide Photographic Element Containing Spot or Streak Prevention Compounds". The latter patent points out that hydroxylated polyamino-polycarboxylic acids, e.g., derivatives of ethylenediaminetriacetic acids, have been used as sequesterants (chelating agents) but with less than satisfactory results. It has now been discovered that a particular combination of the foregoing sequesterants is surprisingly effective in preventing spot formation in silver halide photographic film without sacrifice of its sensitometric properties.

SUMMARY OF THE INVENTION

A combination of a phosphate and trisodium hydroxyethylethylenediaminetriacetate inhibits spot formation in developed silver halide films, more particularly in photographic elements comprising a support and at least one silver halide emulsion layer on the support. Sodium metaphosphate is a preferred phosphate. The magnitude of the inhibitor effect for this particular combination is an unexpected result, because other combinations which might be expected to act similarly display a normal additive relationship in reducing the spot formation of developed films. An effective amount of sodium metaphosphate (mol. wt. approx. 1325) is from 0.1 to 1.0 millimoles per mole of silver halide. It can be added to the emulsion or to an auxiliary layer of the film, preferably a layer adjacent to the emulsion layer, such as a gel (gelatin) subbing layer. An effective amount of trisodium hydroxyethylethylenediaminetriacetate is from 0.01 to 2 millimole per mole of silver halide. It, too, can be added to the emulsion or to an auxiliary layer of the film. The combination is effective regardless of whether the phosphate and triacetate are in the same layer or in separate layers.

Sodium metaphosphate has the structure:

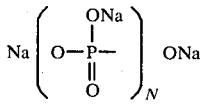

where N is 11 to 15. Other effective phosphates include polymeric sodium pyrophosphate, plus sodium phosphate (tripoly), as well as monobasic, dibasic, and tribasic sodium, potassium, and ammonium phosphates.

Trisodium hydroxyethylethylenediaminetriacetate has the structure:

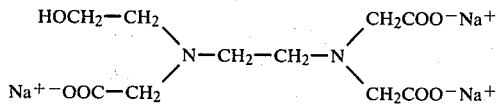

The phosphate and chelate may be added before, during, or after the digestion step for the emulsion.

DETAILED DESCRIPTION OF THE INVENTION

Two mechanisms appear to be effective in preventing spot formation. Phosphates prevent iron from undergoing oxidation, or, in alternate terminology, inhibit corrosion. Trisodium hydroxyethylethylenediaminetriacetate functions as a chelating or sequestering agent for metal ions; thus it ties up iron ions to prevent spot formation. It is sold by the Organic Chemicals Division of W. R. Grace and Co. under the trade name of HAMP-OL120.

The following examples serve to illustrate the invention. Example 1 represents the best mode contemplated by the inventor of carrying out his invention.

EXAMPLE 1

A high speed ortho-sensitized silver iodobromide emulsion (1.4% Iodide) was coated on a gelatin-subbed polyethylene terephthalate support which contained a high level of metal dust contamination, making this support unacceptable for normal manufacturing purposes. The emulsion contained a chelating agent for the purpose of inhibiting spot formation, i.e., 0.15 millimoles per mole of silver halide of diethylenetriamine pentaacetic acid (mol. wt.=393). The resulting film served as Control No. 1.

To an identical portion of the above emulsion was also added 0.2 millimole per mole of silver halide of sodium metaphosphate (mol. wt. 1325). The resulting film containing both chelate and phosphate was coated on the contaminated support and served as Control No. 2.

An emulsion was coated without any spot control addition and served as Control No. 3.

An experimental emulsion was prepared with the addition of both 0.2 millimole per mole of silver halide of sodium metaphosphate and 1.0 millimole per mole of silver halide of trisodium hydroxyethylethylenediaminetriacetate (MW 344). This was coated on the contaminated support to serve as an example of the present invention.

Samples of the three controls and the experiment were exposed with a Cronex ® sensitometer (available from Du Pont Photo Products) and developed in a medical X-ray developer. The developed samples were examined to determine the incidence of spots in these films. The controls and the experiment gave equivalent sensitometry.

Controls 1 and 3 showed a very severe level of spots which made the film unusable for medical diagnosis.

Control 2 showed a level of spots lower than Control 1 but still so severe that the film was unusable for medical diagnosis.

The experimental emulsion exhibited a minute level of spots, which would not interfere with medical diagnosis. On a numerical rating scale the spot severity would be Control 1=97, Control 2=90, Control 3=100, Experiment=8.

EXAMPLE 2

A gelatin subbing solution was prepared. Iron dust and spot inhibitors were added to portions thereof, prior to coating it on a polyethylene terephthalate support. The gel-subbed supports were overcoated with a gold-sulfur sensitized silver iodobromide X-ray emulsion (1.2% Iodide), and the resulting film samples were exposed and developed. Table 1 summarizes the results.

TABLE 1

| Gel Sub Addition (mg/dm$^2$) Impurity | Spot Inhibitor | Emulsion Addition (millimole/mole AgX) | Spots per cm$^2$ | Effect on Sensitometry |
|---|---|---|---|---|
| None | None | None | 0 | None |
| Iron dust $4 \times 10^{-6}$ | None | None | 28 | None |
| Iron dust $4 \times 10^{-6}$ | Sodium metaphosphate (.2) | Sodium metaphosphate .17 | 9 | None |
| Iron dust $4 \times 10^{-6}$ | Sodium metaphosphate (.2) | Diethylenetriamine Pentaacetic acid .26 | 13 | None |
| Iron dust $4 \times 10^{-6}$ | Sodium metaphosphate (.2) | Trisodium hydroxyethylethylenediamine triacetate .67 | 6 | None |

This demonstrates the surprising efficacy of the phosphate/chelate combination of this invention, and also demonstrates that spot reduction can be accomplished by incorporating such additives into to a layer other than the emulsion.

EXAMPLE 3

Control and experimental coatings of a gold-sulfur sensitized silver iodobromide industrial X-ray emulsion (1.2% iodide) were made on a gelatin-subbed polyethylene terephthalate support contaminated with iron particles. The experimental films contained 0.15–1.33 millimole chelate and 0.1–0.7 millimole phosphate per mole of silver halide. All film samples were given an industrial X-ray exposure and processed in X-ray developer. Table 2 contains results.

TABLE 2

| Emulsion Addition | Speed | Gradient | B&F[1] | Black Spots #/10 cm$^2$ | Black Spots Size mm |
|---|---|---|---|---|---|
| None - Control | 239–246 | 4.34–4.61 | .11 | 14 | .4–2.0 |
| ethylenediamine tetraacetic acid | 265 | 4.47 | .11 | 14 | .2–1.0 |
| trisodium hydroxyethylethylenediamine triacetate + sodium metaphosphate | 247 | 4.34 | .11 | 8 | .2 |

[1]Base + fog

This illustrates that the combination of the present invention is superior in reducing both the number and size of the spots relative to a control combination of sodium metaphosphate and a prior art chelating agent. Similar results were obtained when the prior art chelating agent employed in the control combination was di- or trisodium ethylenediaminetetraacetic acid, i.e., a chelate having no ethyl group.

The present invention is not limited to the use of a particular support or film base, as the silver halide emulsions may be coatd on various films and plates, using various sublayers and auxiliary layers, and conventional additives, as described more fully in U.S. Pat. No. 3,142,568 at column 9, line 27 to column 10, line 3, which lines are hereby incorporated by reference. Similarly, the silver halide emulsion need not be limited to silver iodobromide but may include all of the common silver halide types used, for example, in graphic arts, medical and industrial X-ray, cine negative or positives, and color films, for example, silver chloride, bromide, chlorobromide, bromoiodide, chloroiodide, or mixtures of chloride-iodide-bromide emulsions.

I claim:

1. A photographic element comprising a support and at least one silver halide emulsion layer on said support, characterized in that the photographic element contains a combination of a phosphate and trisodium hydroxyethylethylenediamine triacetate; said combination being employed in an amount effective to reduce metal particle contamination.

2. The combination of claim 1 wherein the phosphate is used in the amount of 0.1 to 1 millimole per mole of silver halide in the emulsion layer, and trisodium hydroxyethylethylenediamine triacetate is used in the amount of 0.1 to 2 millimole per mole of silver halide in the emulsion layer.

3. The combination of claim 1 wherein either one or both ingredients of the combination may be contained in the silver halide emulsion layer or a layer adjacent to said emulsion layer.

4. The combination of claims 1, 2, or 3 wherein the phosphate is sodium metaphosphate.

5. In a manufacturing process for producing silver halide photographic film wherein a support is coated with at least one silver halide emulsion layer, and wherein the film is contaminated by iron particles which cause spotting of the exposed film upon development, the improvement wherein the spots are reduced in number by incorporating into said film both sodium metaphosphate and trisodium hydroxyethylethylenediamine triacetate, these additives being employed in the amounts stated in claim 2.

6. The process of claim 5 wherein one or both of the additives are incorporated into the silver halide emulsion layer, or a layer adjacent to said emulsion layer.

7. The process of claim 6 wherein said layer adjacent to said emulsion layer is a gelatin subbing layer which underlies the silver halide emulsion layer.

* * * * *